US005448258A

United States Patent [19]

Edwards

[11] Patent Number: 5,448,258

[45] Date of Patent: Sep. 5, 1995

[54] ACTIVE MATRIX DISPLAY DEVICES

[75] Inventor: Martin J. Edwards, Crawley, England

[73] Assignee: U.S. Philips Corporation, New York, N.Y.

[21] Appl. No.: 141,147

[22] Filed: Oct. 21, 1993

[30] Foreign Application Priority Data

Nov. 12, 1992 [GB] United Kingdom ..... 9223697

[51] Int. Cl.[6] ..... G09G 3/36

[52] U.S. Cl. ..... 345/90; 345/92

[58] Field of Search ..... 345/147, 148, 149, 90, 345/91, 100, 92

[56] References Cited

U.S. PATENT DOCUMENTS 5,012,228 4/1991 Masuda et al. ..... 345/92
5,061,920 10/1991 Nelson ..... 345/98
5,170,158 12/1992 Shinya ..... 345/98
5,296,870 3/1994 Nicholas ..... 345/149

FOREIGN PATENT DOCUMENTS 0391654 10/1990 European Pat. Off. .
2233469 1/1991 United Kingdom ..... 345/90

OTHER PUBLICATIONS

R. E. Suarez et al., "All-MOS Charge Redistribution Analog-to-Digital Conversion Techniques—Part II", IEEE Journal of Solid-State Circuits, Dec. 1975, pp. 379-385.

P. E. Allen et al., Book entitled: "CMOS Analog Circuit Design", published 1987, pp. 544-550.

*Primary Examiner*—Alvin E. Oberley
*Assistant Examiner*—Kent Chang
*Attorney, Agent, or Firm*—Robert J. Kraus

[57] ABSTRACT

An active matrix display device having an array of picture elements (12) comprising capacitive display elements, for example, liquid crystal elements, driven by row and column drive circuits (21,25) via row and column conductors (18,19) in which the column drive circuit (25) supplies multi-bit digital data signals to the column conductors (19) and in which each picture element is configured as a serial charge redistribution digital to analogue converter circuit for providing the analogue voltage required by the display element. The converter circuit can comprise two switching devices (T1,T2), e.g. TFTs, and two capacitors obtained by dividing the display element into two sub-elements (CP1,CP2). Row conductors (18) may be shared between adjacent rows of picture elements.

7 Claims, 4 Drawing Sheets

ACTIVE MATRIX DISPLAY DEVICES

BACKGROUND OF THE INVENTION

This invention relates to an active matrix display device comprising sets of row and column conductors, an array of picture elements each comprising a capacitive display element and a switching device connected to a row conductor and a column conductor, and drive means for driving the picture elements comprising a row drive circuit for applying switching signals to the row conductors, a column drive circuit connected to the column conductors for applying data signals to the column conductors, and means for supplying a digital picture information signal to the column drive circuit from which said data signals are derived.

An active matrix display device of this kind, and in which the display elements comprise liquid crystal display elements, is described in EP-A-0391654.

Display devices having column drive circuits operating with digital Picture-information video, signals can offer advantages over those operating with analogue video signals, particularly in certain applications such as data-graphic display apparatus. The digital video signals can be obtained by digital video processing circuits which generally are capable of greater flexibility than their analogue counterparts. Digital video signals could be supplied for example from a RAM store of a computer or, alternatively, provided by converting analogue TV video signals into digital form.

The display device described in the aforementioned specification includes a TFT liquid crystal panel of conventional type having a row and column array of picture elements which each include a TFT and which are addressed via sets of row and column conductors with selection signals being applied to each row conductor in turn so as to turn on the TFTs of the picture elements associated with that row conductor whereby data signals on the column conductors are transferred to respective display elements.

In the column drive circuit of the display device described in the aforementioned specification, the digital video signals are converted into analogue (amplitude modulated) data signals and these analogue data signals are applied to the column conductors of the display panel, and thence to the display elements via their TFTs to provide the analogue voltages necessary for operating the liquid crystal display elements. The amplitude of this analogue voltage determines the display effect, e.g. grey scale, produced by the display elements. The digital to analogue conversion in the column drive circuit involves translating multi-bit digital signals into pulse width modulated pulse signals, e.g. pulses whose widths are determined by the multi-bit digital signals, which are then used to sample a time-varying reference voltage so as to obtain output voltages, constituting the data signals, whose amplitudes are dependent on the durations of the time dependent signals.

Although capable of operating with an input digital video signal, this display device suffers from a number of disadvantages. The column drive circuit is not truly digital but comprises a mixture of digital and analogue circuitry. The analogue part can be expected to impose limitations on the performance of this circuit. Moreover, the fabrication of this circuit is complicated by the need to provide both digital and analogue components. This is particularly disadvantageous in the case where the drive circuit is to be fully integrated in the display panel and fabricated simultaneously with the components of the display panel using TFTs since analogue circuits using TFTs and offering adequate performance are generally more difficult to make.

SUMMARY OF THE INVENTION

It is an object of the present invention to provide an improved display device operable with input digital picture information signals which is capable of overcoming the above disadvantages at least to some extent.

It is another object of the present invention to provide a display device for operating with digital picture information signals in which the column drive circuit is comparatively simple and capable of operating at high speeds.

According to the present invention, there is provided an active matrix display device of the kind described in the opening paragraph, which is characterised in that the column drive circuit is operable to supply multi-bit digital data signals to the column conductors and in that the display element and the switching device of each picture element comprise parts of a respective serial charge redistribution digital to analogue converter circuit for converting a multi-bit digital data signal on a column conductor to an analogue voltage for the display element.

Thus the voltage on a display element of a picture element following its addressing, and hence the display effect, e.g. grey scale, produced, is dependent on, and determined by the multi-bit digital data signal. With this technique the conversion of the digital picture information, video, signals to analogue signals required by the electro-optical, e.g. liquid crystal, material takes place in the picture elements. Accordingly, the need to convert digital video signals into pulse width modulated signals and then to analogue (amplitude modulated) voltages in the column drive circuit prior to supply to the column conductors as described in the aforementioned EP-A-0391654 is removed. Consequently, the necessary data column drive circuit is considerably simplified, and importantly can readily be implemented using purely digital circuitry. This is of particular significance to the integration of the column drive circuit on a substrate of the display panel, using for example TFTs fabricated at the same time as those associated with the display elements, which is difficult to achieve satisfactorily when analogue processing is involved. Moreover, a purely digital column drive circuit is capable of operating at comparatively high speeds and without the kind of limitations imposed by the presence of analogue circuitry. By in effect moving the digital to analogue conversion function to the picture element array the analogue circuitry is required only to operate at a speed significantly lower than the video data rate and the high speed capability of the digital column drive circuit can be fully exploited.

Serial charge redistribution digital to analogue converter circuits are known per se. Examples of such circuits and the theory of their operation are described in the article entitled "All-MOS Charge Redistribution Analog-to-Digital Conversion Techniques - Part II" by R. E. Suarez et al published in IEEE Journal of Solid-State Circuits, December 1975 at pages 379 to 385, and at pages 544 to 550 in the book entitled "CMOS Analog Circuit Design" by P. E. Allen and D. R. Holberg, published in 1987 by Holt, Rinehart and Winston Inc.

This kind of converter circuit generally comprises a combination of at least two switches and two capacitors. The switching device, e.g. a TFT, and the display element of a picture element are, in accordance with the invention, utilised to provide switch and capacitor components respectively of the converter circuit. The further one, or more, switches required for the converter circuit can readily be provided by incorporating an additional TFT or TFTs at the picture element location.

The display element may constitute one capacitor of the converter circuit and the additional capacitor or capacitors needed for the converter circuit provided by fabricating a thin film layer structure constituting a capacitor on the substrate together with the switching devices. Preferably, however, the display element of each picture element comprises at least two display sub-elements, each of which constitutes a respective capacitor component of the converter circuit. Consequently, the display elements provide the necessary capacitors in simple and convenient fashion and the need to fabricate additional capacitors for the converter circuit is avoided. Moreover, the values of the capacitors thus obtained are easily determined. In order to provide two capacitors of substantially equal value, the display element is simply divided into two sub-elements of substantially equal area. The areas, and capacitances, of the sub-elements need not be equal but could differ in order to compensate for the effects of parasitic capacitances in the circuit, for example, associated with the switching devices. Such sub-division of a display element into two or more sub-elements can conveniently be accomplished by defining a deposited electrode layer on the substrate so as to form two, or more, discrete regions for each picture element rather than a single region as is customary. Sub-division of display elements in display devices to form a plurality of display sub-elements has been used previously in liquid crystal display devices for other purposes, for example as a means for controlling grey scale in the display output with the sub-elements being independently energisable.

In a preferred embodiment of the invention the converter circuit comprises two capacitors and two switching devices. Such a circuit can conveniently be realised by providing two sub-elements for each display element, the two sub-elements constituting respective capacitors, and two switch devices, for example TFTs, one of which is constituted by the switch device normally present in an active matrix display device. Then, only one further switch device, e.g. TFT, is required at each picture element to provide the components needed for the converter circuit. The addition of a further switch device at each picture element does not unduly complicate fabrication. It is already known to provide two switch devices, e.g. TFTs, for each picture element in display devices for fault tolerance purposes. The necessary interconnections between the sub-elements, switching devices, and row and column conductors for the converter circuit can be provided in simple manner by suitably defining one or more conductive layers, as in conventional picture element circuits.

In order to operate a serial charge redistribution digital to analogue converter circuit, the switching devices of the circuit are turned on and off in a predetermined sequence. To this end corresponding switching devices in the converter circuits of a row of picture elements may be connected to respective row conductors and switching signals applied to these row conductors by the row drive circuit in the appropriate sequence. Two separate row conductors would then be required to address the two switching devices of the converter circuits of each row of picture elements. Preferably, however, in order to minimise the number of row conductors, a first switching device of each converter circuit of the picture elements in one row is connected to a respective row conductor and the second switching devices of the converter circuits of said picture elements are connected to another row conductor to which the first switching devices of an adjacent row of picture elements are also connected. Thus, row conductors are shared between adjacent rows of picture elements, apart from the first and last row of picture elements. The number of row conductors then corresponds to the number of rows of picture elements in the array, with one additional row conductor being required for the first or last row.

Each row of picture elements may be addressed in turn with digital data signals for one row of picture elements being applied to the column conductors and thereafter digital data signals for the next row of picture elements being applied and so on. During one row address period, the two switching devices of each picture element in the row are operated alternately with the first serving to load a data bit into the converter circuit and the second serving to effect charge sharing. The charging period available is dependent on the line period of the input video signal and the number of bits in the multi-bit data signal and consequently is limited. Preferably, therefore, the row drive circuit provides switching signals for operating in sequence the switching devices of picture elements in two rows during a common address period and the column drive circuit provides for each column conductor multi-bit digital data signals for respective picture elements in the two rows in said common address period with the bits of one multi-bit digital data signal being interleaved with the bits of the other digital data signal. As the picture elements in two rows are addressed in parallel in the same address period, the time available for addressing each row, and thus the charging time, can be doubled. This is possible bearing in mind that for a given row of picture elements the first switching devices of the converter circuits are operated at spaced intervals, the intervals corresponding to the period in which the second switching devices are operated. Thus, by, for example, alternating the bits of two data signals intended for respective picture elements in two rows, and by providing switching signals to the row conductors associated with the two rows of picture elements in appropriate synchronised sequence, more efficient use is made of available time.

The individual bits of a multi-bit digital data signal may each comprise one of two predetermined voltage levels. The number of individual bits may be, for example, four, six or eight depending on the required resolution. For high resolutions, more bits are necessary and so greater performance from the switching devices is required as individual charging periods are reduced. In order to increase the resolution of the conversion without necessarily reducing the individual charging periods the bits of a multi-bit digital data signal may each comprise one of n predetermined levels where n is greater than two. Thus, each bit may comprise one of three or four possible levels. By increasing the number of possible levels to four, for example, the conversion resolution may be increased by a factor of two. To this end, some bits of the multi-bit data signal generated in the column drive circuit are used to determine which voltage level is applied to a column conductor for each cycle of the D/A conversion. For example, for an eight bit data signal generated in the column drive circuit, four bits may be used to determine one of four possible voltage levels while the other four bits, at appropriately determined levels, are supplied to a picture element for conversion.

BRIEF DESCRIPTION OF THE DRAWING

Active matrix display devices, and methods of driving such, in accordance with the present invention, will now be described, by way of example, with reference to the accompanying drawing, in which.

It should be understood that the Figures are merely schematic and are not drawn to scale. It should also be understood that the same reference numerals are used throughout the Figures to indicate the same or similar parts.

DESCRIPTION OF THE PREFERRED EMBODIMENTS

Figure 1:
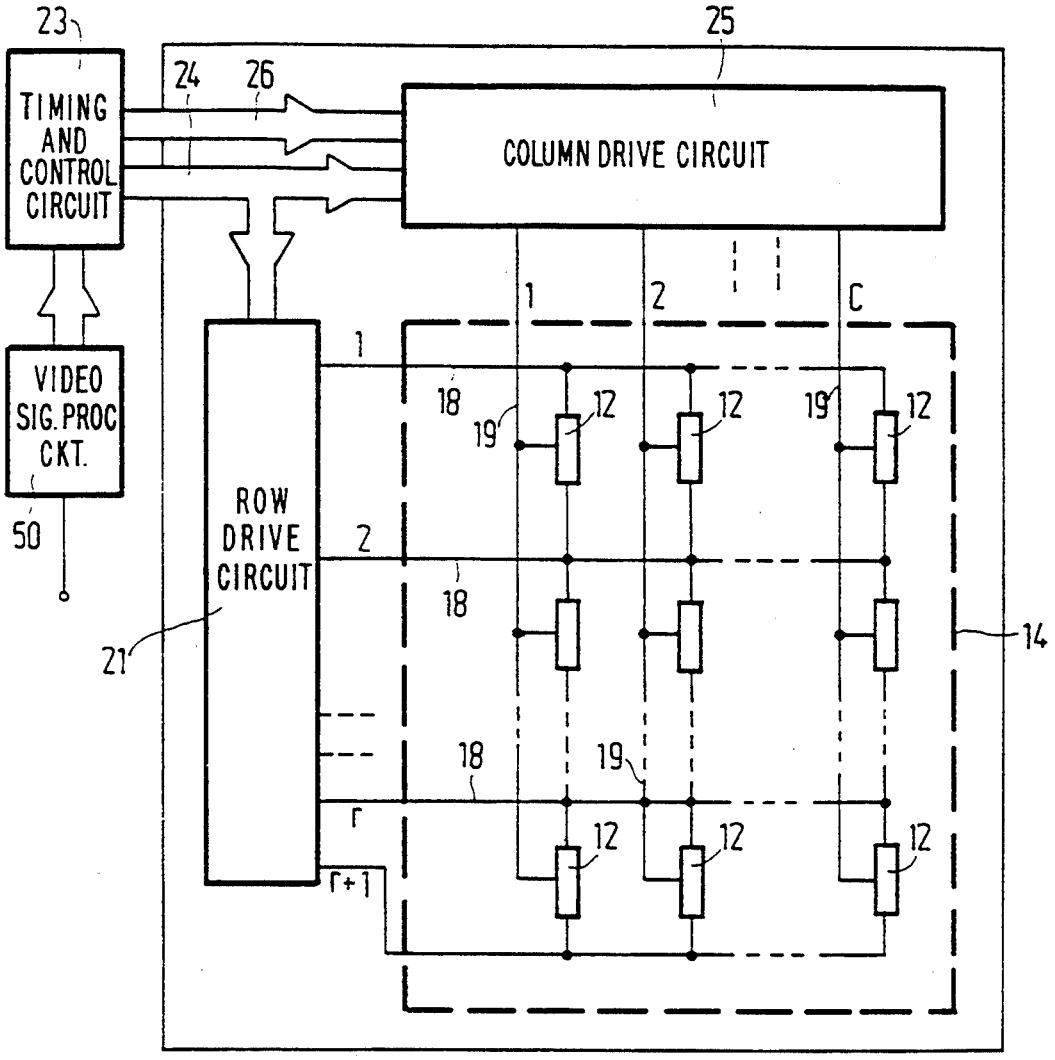
FIG. 1 is a schematic block diagram of an active matrix liquid crystal display device according to the present invention.

Referring to FIG. 1, the active matrix liquid crystal display device comprises a display panel having a row and column array of liquid crystal picture elements 12 defining a display area 14. The picture elements 12 include capacitive display elements comprising spaced electrodes carried respectively on the opposing surfaces of two spaced glass substrates with TN liquid crystal material disposed therebetween. The display element electrodes on the one substrate are constituted by respective regions of a continuous counter electrode layer, common to all display elements in the array. The other electrodes of the display elements comprise individual electrodes which are carried on the other substrate together with switching devices of the picture elements in the form of TFTs. The picture elements 12 of the array are addressed via sets of row and column address conductors, 18 and 19, also carried on the substrate with the individual display element electrodes, each picture element being located adjacent a respective intersection of the row and column conductors. Each row of picture elements is connected to a respective pair of row conductors 18 while, apart from the first and last row conductors, each row conductor is connected to the picture elements in two adjacent rows. All picture elements in the same column are connected to a respective column conductor 19. There are r rows and c columns of picture elements, providing a total of r.c picture elements in the array. In many respects the display panel is generally similar in construction to conventional active matrix, TFT, liquid crystal display panels and consequently will not be described here in detail.

The picture element array is driven by peripheral drive means including a row drive circuit 21 which scans the rows of picture elements successively by applying switching pulse waveform signals, as will be described, to the row conductors 18 in sequence, which operation is repeated for successive fields. To this end, the row drive circuit differs from conventional row drive circuits for TFT display panels which are required simply to provide a selection (gating) pulse to each row conductor in turn. The row drive circuit 21 is controlled by timing signals provided along a bus 24 from a timing and control circuit 23 to which a digital video signal is supplied from a video signal processing circuit 50. The circuit 23 also supplies the necessary potential levels defining the switching waveform signal levels.

The peripheral drive means further includes a column drive circuit 25 to which a digital video picture information signal is supplied by the circuit 23 along a bus 26 and which operates to apply to the set of column conductors 19 appropriately in parallel for each video line in turn data signals in multi-bit digital form.

In common with conventional analogue column drive circuits, writing of video information to the picture element array takes place on a line-by-line (row-by-row) basis in which a line of video information is sampled by the column driver circuit and subsequently written to the picture elements in a selected row, the identity of the selected row being determined by the row drive circuit.

A digital video signal applied to the column drive circuit 25 requires de-multiplexing so that the samples from a complete line of video information can be stored in latch circuits of the column drive circuit as appropriate to their associated column of picture elements.

Column drive circuits operating with digital video signals are known per se, for example as disclosed in EP-A-0391654 whose disclosure in this respect is incorporated herein by reference. However, in such known circuits the digital data signals obtained in the column drive circuit are converted into analogue data signals in the column drive circuit and these analogue signals are then supplied to the column conductors for transfer to the picture elements. The column drive circuit 25 differs from these known circuits in that D/A conversion circuitry is not present and instead the multi-bit digital data signals are supplied directly to the column conductors. To this end, the multi-bit digital data signals may be derived in the column drive circuit 25 in a similar manner, for example as obtained from the output of the digital data memory circuit of the column drive circuit described in EP-A-0391654, except that each multi-bit data signal is supplied to a column conductor in a serial rather than parallel format. Other forms of column drive circuits for supplying the required multi-bit signals to the column conductors could be employed, as will be apparent to persons skilled in the art.

For simplicity, it is assumed in this embodiment that the display device is a black and white display device.

The display device could alternatively be a full colour display device in which a three colour (R,G,B) microfilter array is associated with the picture element array. In this case, the column drive circuit would be suitably modified to handle separate R, G and B digital video signal inputs in known manner, for example using the kind of approach described in EP-A-0391654.

Figure 2:
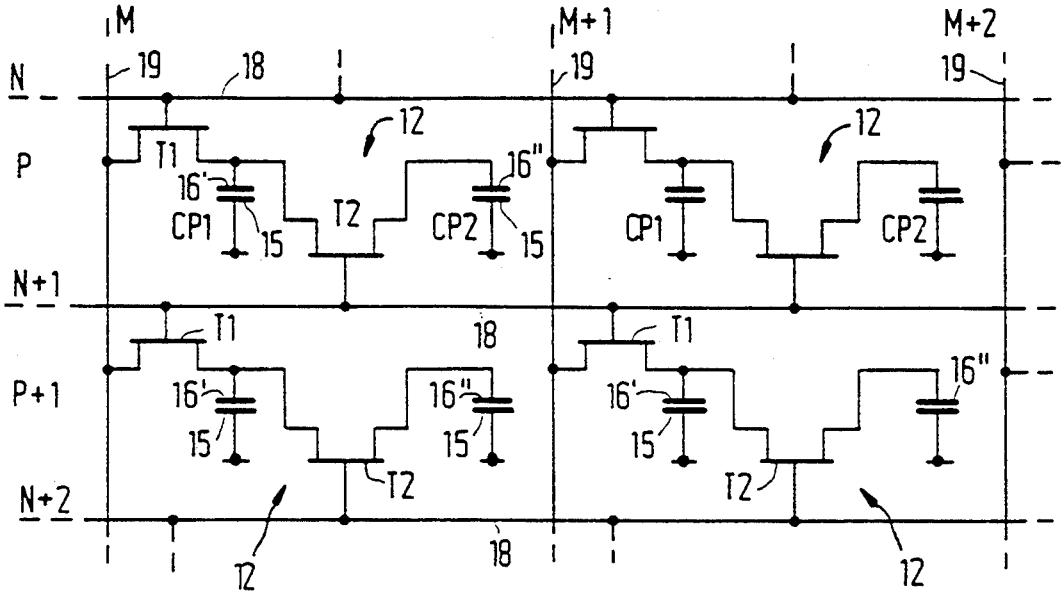
FIG. 2 illustrates schematically the circuit configuration of a typical group of picture elements in an array of picture elements of a display panel of the device of FIG. 1, each picture element comprising a serial charge redistribution digital to analogue converter circuit.

Each of the picture elements 12 comprises a serial charge redistribution digital to analogue converter circuit which is operable to convert the multi-bit digital data signals applied thereto via the column conductors to analogue voltages for use by the display elements. Referring to FIG. 2, there is shown schematically the circuit configuration of a typical group of picture elements in the picture element array, the group consisting of two adjacent picture elements 12, in columns M and M+1, in two successive rows of picture elements, row P and row P+1. The display element electrodes of the picture elements on the one substrate carrying the row and column conductors comprise sub-electrodes, there being for each display element two discrete sub-electrodes, 16' and 16'', of substantially equal area which, together with the common electrode carried on the facing substrate, here denoted 15, define two display sub-elements CP1 and CP2 of substantially equal capacitance value. In effect, a conventional form of display element is divided into two discrete parts. In the case of a display panel in which storage capacitors are provided for the display elements, the storage capacitors can in effect similarly be divided into two discrete elements of substantially equal value, each being associated with a respective display sub-element.

Each picture element 12 further includes two TFTs, T1 and T2 fabricated on the same substrate as the row and column conductors. The gates of the TFTs T1 of the row P of picture elements are connected to the row conductor N, while their sources are connected to respective column conductors 19. The drain of each TFT T1 is connected to the sub-electrode 16' of the associated display sub-element CP1 and also to the source of the second TFT, T2. The drain of the TFT T2 is connected to the sub-electrode 16'' of the associated display sub-element CP2. The gate of the TFT2 is connected to the next, immediately adjacent, row conductor, N+1, to which the gates of the TFTs T1 of the following row of picture elements in the array are also connected. The TFTs T1 and T2 of each row of picture elements are thus connected respectively to an adjacent pair of row conductors, with each row conductor, apart from the first and last, being connected in this manner to two rows of picture elements. The interconnections between the TFTs, the display sub-elements and the row and column conductors are defined by appropriate patterning on one or more deposited layers of conductive material. The circuit arrangement of the display sub-elements (capacitors) CP1 and CP2 and the TFTs T1 and T2 of a picture element constitute a serial charge redistribution digital to analogue converter circuit.

Although the two display sub-elements CP1 and CP2 are described as having substantially equal areas and capacitances, they could in practice be chosen deliberately to have different areas, and hence capacitances, so as to compensate for the effects of parasitic capacitances in the converter circuit. In this respect it will be appreciated that the sub-element CP2 is connected to one TFT, T2, having a gate/drain capacitance while the other sub-element CP1 is connected to two TFTs, T1 and T2, having gate/drain and gate/source capacitances respectively.

Figure 3:
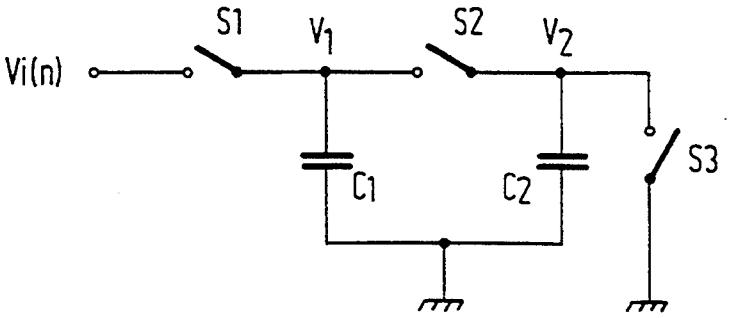
FIGS. 3 and 4 are schematic diagrams showing respectively the circuit of a serial charge redistribution type of digital to analogue converter and example waveform signals applied thereto for illustrating the operation of such a converter.
Figure 4:
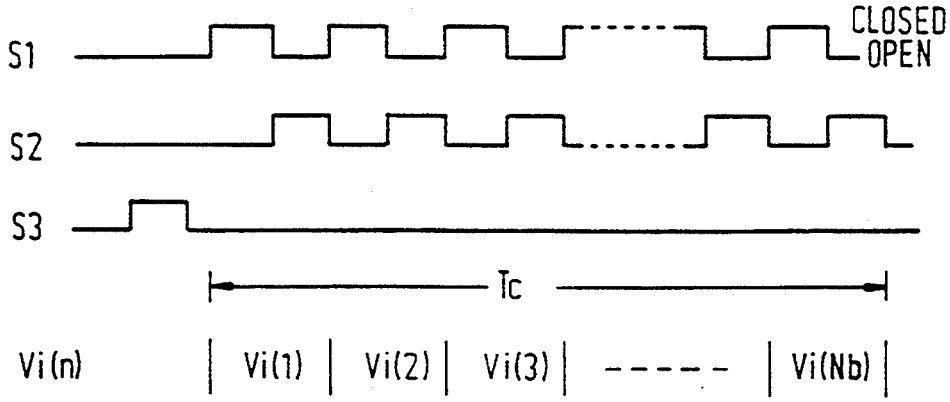

Digital to analogue converters of the serial charge redistribution type are known and have been used in applications other than active matrix display panels. Examples of such converters are described in the paper by Suarez et al and the book by Allen & Holberg referred to previously and reference is invited to these publications for information on their configuration and operation. A brief description of their general operation will now be given, with reference to FIG. 3 which illustrates the circuit of an example of such a circuit and FIG. 4 which illustrates typical waveforms present in operation. The circuit consists of three switches, S1, S2 and S3, and two capacitors C1 and C2 of substantially equal values connected in the manner shown. The values of the capacitors C1 and C2 are nominally equal.

To perform a conversion, switch S3 is first closed to discharge C2 and to set the voltage at point V2 to zero. There then follow a number of cycles during which the switches S1 and S2 are operated. During each cycle a voltage, Vi(n), is applied to the input of the circuit. This voltage takes one of two values and represents the state of each bit in turn of the digital data to be converted. This data is presented to the circuit serially with the least significant bit first. During each cycle of the conversion the switch S1 is first closed allowing the capacitor C1 to charge to the input voltage level. Switch S1 is then opened and switch S2 closed allowing charge sharing to take place between the two capacitors. The voltages V1 and V2 equalise and S2 is then opened once more to complete the cycle. The conversion period is indicated at Tc in FIG. 4.

The number of cycles, Nb, determines the resolution, i.e. the number of bits, of the conversion. At the end of the conversion the voltages V1 and V2 have a value $V_F$ which it can be shown is given by the expression $$V_F = \sum_{n=1}^{Nb} Vi(n) \times \frac{2^{(n-1)}}{2^{(Nb)}}.$$

The sequence of digital input bits is effectively scaled by increasing powers of two and the final voltage therefore represents the analogue equivalent of the digital data fed into the circuit.

Figure 5:
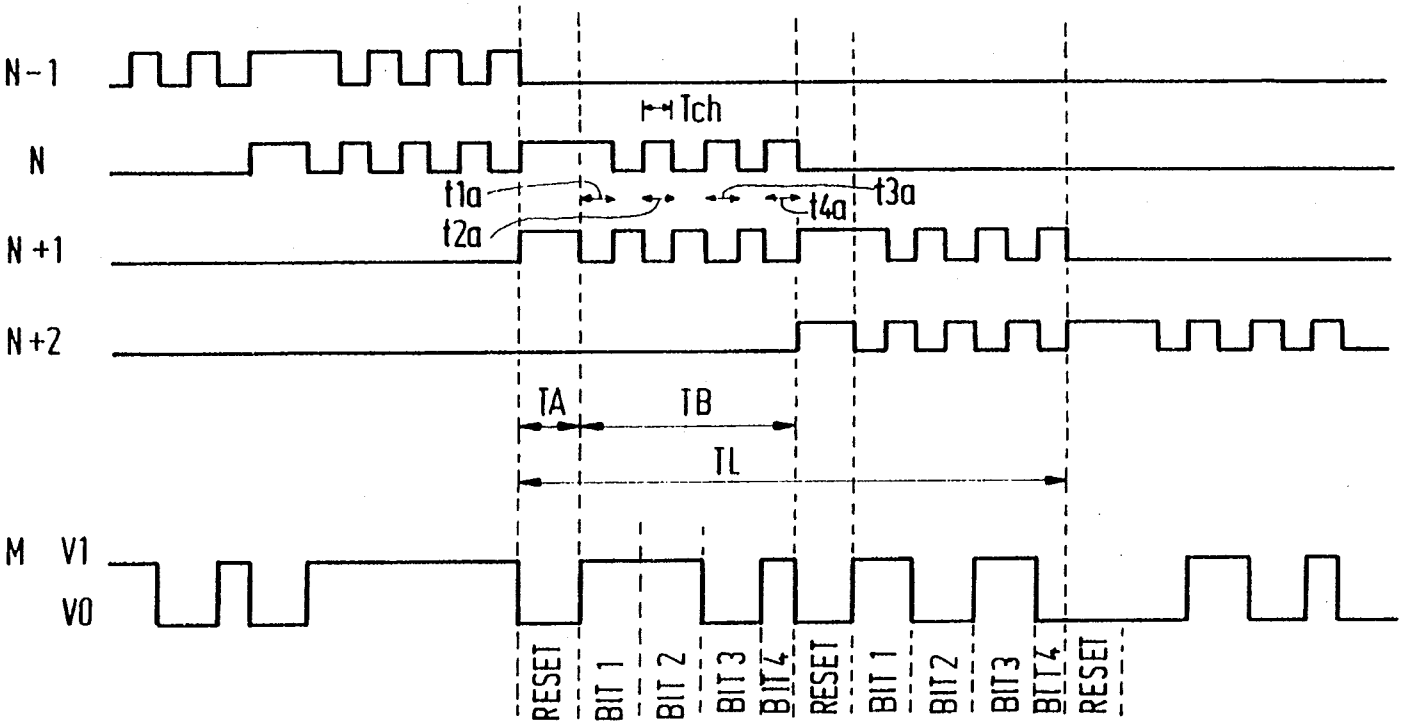
FIG. 5 shows example signal waveforms applied to the row and column conductors of the display panel of the device of FIG. 1 using a first drive scheme.

Referring now again to FIG. 2, the two display sub-elements CP1 and CP2 constitute the two capacitors of the converter circuit. The TFT T1 performs the same function as the switch S1 in FIG. 3 while the function of the TFT T2 is the same as that of switch S2. The common electrode 15 of the display element is held at a constant reference potential $V_{CE}$, which, for example, may be ground. It is seen, therefore, that the picture element 12 contains all the elements of the converter circuit of FIG. 3 except the discharging switch S3. However the voltage on CP2 can still be discharged, or reset, simply by holding the column voltage at an appropriate level and simultaneously turning on both TFT T1 and TFT T2. Appropriate row drive waveforms for addressing a full resolution display having this picture element/converter circuit configuration are shown in FIG. 5 in which $V_{N-1}$, $V_N$, $V_{N+1}$ and $V_{N+2}$ represent the voltage waveforms applied to a typical group of four successive row conductors 18. The waveforms are diagrammatic and are not drawn to scale. This Figure also illustrates an example of a voltage waveform, $V_M$, applied to a column conductor. In this example, it is assumed that the display panel is driven using the so-called line pairing drive scheme, in which two rows of picture elements are addressed in each video line period TL, and that a four bit digital to analogue conversion is carried out within the picture elements, i.e. Nb=4.

To illustrate the operation of the display device consideration will be given to the addressing of the row P of picture elements (FIG. 2) by way of example. Other rows of picture elements are driven in similar manner. The voltages of the display elements of the picture elements in the row P are reset during the period TA when both TFTs T1 and T2 of each picture element are turned on. This is achieved by the row drive circuit taking row conductors N and N+1 connected to the picture elements of row P to a high voltage and holding the columns at the voltage corresponding to a low bit, V0. At the end of this period the row conductor N+1 returns to a low voltage turning TFT T2 off. The data conversion takes place during the period TB. Voltages are set up on the column conductors of the display panel which represent each bit of the video data in turn. During period t1*a* voltages representing the least significant bits, bit 1, are applied to the columns conductors, during period t2*a* voltages for bit 2 are applied to the column conductors, and so on. In each of these periods row conductor N is taken to a high voltage in order to turn on TFT T1 and charge CP1. In the intervening periods the row conductor N has a low voltage and the row conductor N+1 is taken high. This turns on TFT T2 and allows charge sharing between CP1 and CP2. The final period of charge sharing in the conversion occurs while the picture elements in the picture element row P+1 are being reset. The voltage on each of the picture element capacitors, i.e. the display sub-elements, at the end of the conversion is substantially equal and represents the analogue equivalent of the digital information applied to the column conductor. It should be noted that any further switching of T2 after the conversion is completed, as occurs when the picture element row P+1 is being addressed, does not affect the final value of the picture element voltage in row P.

Each row of picture elements in the display panel is driven in this fashion in succession, and the operation repeated for subsequent fields.

Figure 6:
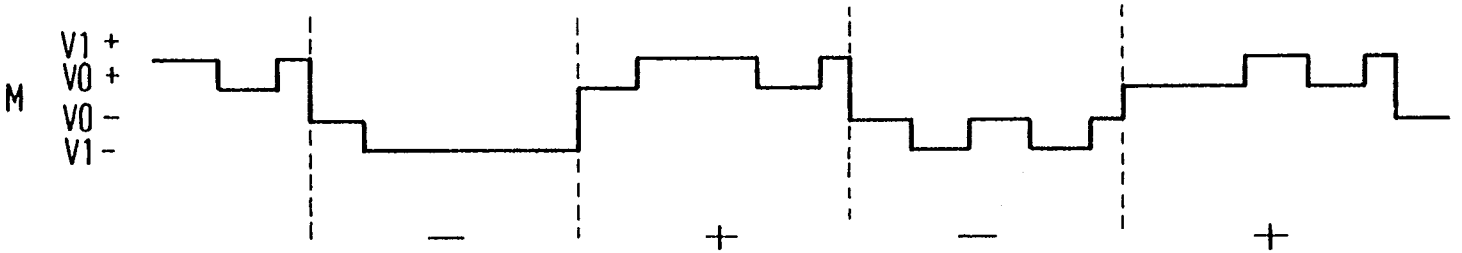
FIG. 6 shows an alternative signal waveform applied to a column conductor in the first drive scheme.

Although in the scheme depicted in FIG. 5 only two values of column voltage are used, V0 and V1, it may be desirable to use different values of V0 and V1 when addressing picture elements with positive and negative signals, as required by the LC material. This is illustrated in FIG. 6 by the alternative form of waveform signal $V_M$ applied to the column conductor which can be used in a display device driven in line inversion mode. The use of such a waveform would allow the voltage range on the display elements to be increased while maintaining the same value of minimum voltage step from the conversion. This kind of waveform can be obtained for example by means of a level shifter circuit in the column drive circuit 25, similar to that described in EP-A-0391654 (with reference to FIG. 5), connected to the output of the decoder circuit and appropriately switching the Vcc and Vdd voltage levels.

The time available to charge the display sub-element capacitance CP1 is determined by the resolution of the conversion, Nb, and the line time of the video signal, TL. With regard to the scheme illustrated in FIG. 5, the period allowed for the resetting of the sub-element voltage, TA, is equal to twice the charging period, Tch. For the described display device, therefore, the charging period is given by:

$$Tch=TL/(4Nb+2).$$

Assuming a four bit conversion (Nb=4) with a video line period of 64 μs, as required for a PAL TV display, the charging time is approximately 3.6 μs. It is possible to increase the charging time available by modifying the row and column drive signals. In the scheme described above the digital information on the column conductors of the display panel is only required to be present while the first TFT, T1, in each picture element is turned on. It is therefore possible to use the intervening periods to supply the column conductors with data for a second row of picture elements, for example the next row of picture elements the display panel. The data conversions for these two rows can then occur in parallel, but, by arranging that the switching signals supplied to the row conductors concerned are in the appropriate synchronised sequence, with the cycle of operations of the second row delayed by a time equal to Tch. By addressing two rows of picture elements in parallel the time available to address each row in the display panel can be doubled.

Figure 7:
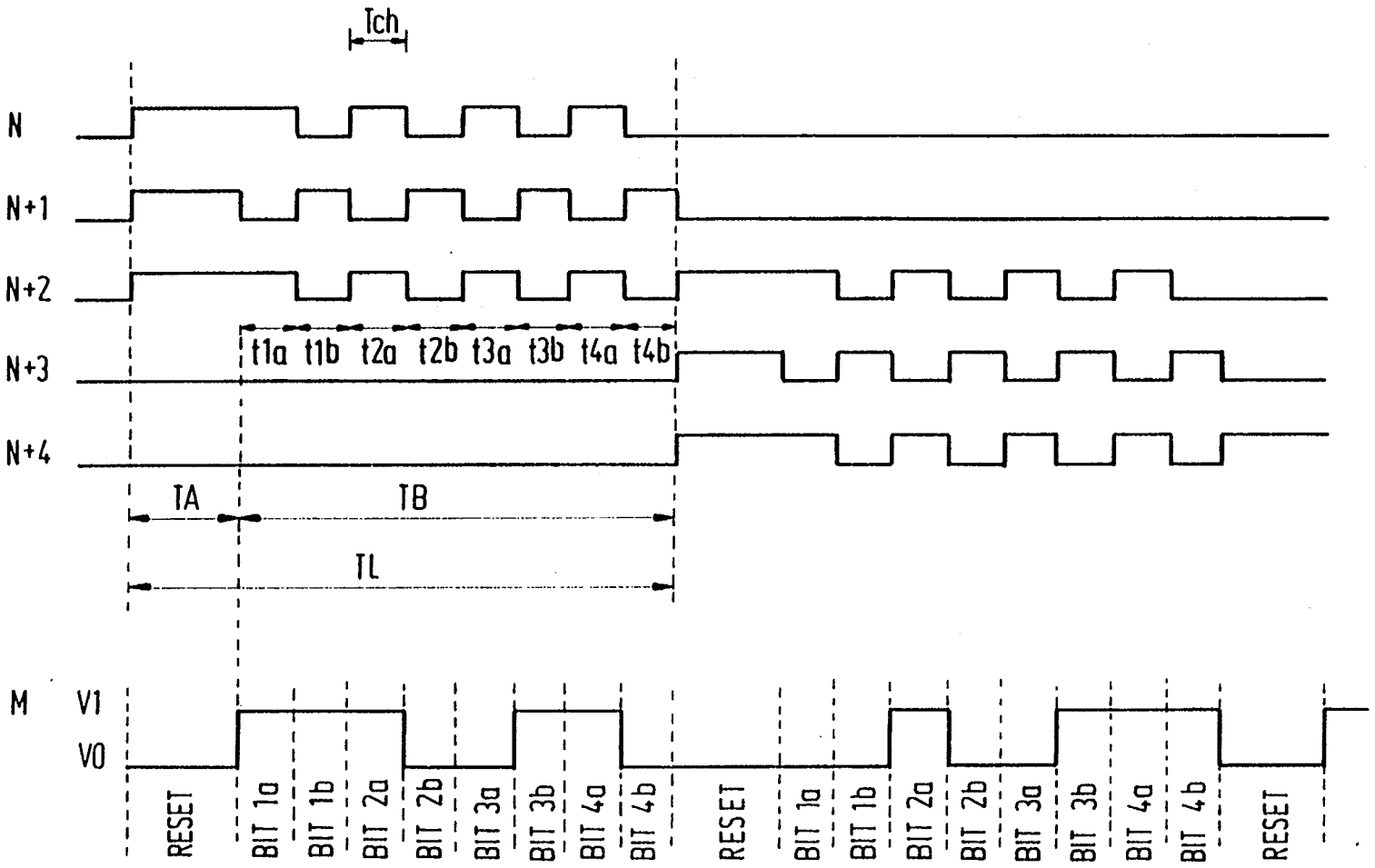
FIG. 7 shows example signal waveforms applied to the row and column conductors of the display panel of the display device of FIG. 1 using a second drive scheme.

An embodiment using an example of this alternative scheme will now be described with reference to FIG. 7 which illustrates diagrammatically typical examples of the waveforms involved for comparison with the corresponding waveforms of FIG. 5. In this scheme, the picture element rows P and P+1 are addressed, using the row conductors N and N+1, and N+1 and N+2 respectively, during the same conversion period, TB. During the charging periods t1*a*, t2*a*, t3*a* and t4*a* the column conductors carry information for the picture element row P. During periods t1*b*, t2*b*, t3*b* and t4*b* the column data is that for the picture element row P+1. Addressing the display panel in this way the picture element charging times can be increased to a value:

$$Tch=TL/(2Nb+2).$$

For a four bit conversion and a PAL display this gives a charging period of 6.4 μs.

When using this approach other than with a line pairing drive scheme, it may become necessary to provide a line memory in the column drive circuit.

From the expressions for the picture element charging time given above it can be seen that there is a direct relationship between the resolution of the conversion, and the available picture element charging time. In practice for TV applications a resolution of at least 6 bits would be desirable and for a high quality display 8 bits or more are required. Using the scheme described above such an increase in resolution would require high TFT performance, with higher on current and lower off current.

However, the resolution of the conversion can be increased without reducing Tch by increasing the number of voltage levels used for the digital data signals applied to the column conductors. In the embodiments described previously two discrete column voltage levels, $V_0$ and $V_1$ or $V_0$- and $V_1$-, are used when addressing a row of picture elements to represent the value of a single bit of the input data signal. By increasing the number of levels to four it is possible to increase the conversion resolution by a factor of two. The values of the four voltage levels required can be calculated from those used with two level data signal. Taking the case where the column conductor voltages required in the two level case are V0 and V1, then with four level column drive the required voltages would be:

V0

$V0+(V1-V0)/2^{Nb}$

V1

$V1+(V1-V0)/2^{Nb}$

Since there are now four possible column conductor voltages, two bits of information are required to determine which of the voltages is applied to a column conductor by the column drive circuit for each cycle of the picture element D/A conversion. This is consistent with the doubling of the overall resolution of the conversion since for a four bit conversion within the picture element eight bit data is required by the column drive circuit. The increase in the number of column conductor voltage levels can be taken further. In the general case where $2^L$ column conductor voltage levels are used the overall conversion resolution is Nb.L bits. However, as the number of voltage levels increases the column drive circuit becomes more complex.

Performing the necessary digital to analogue conversion at the picture elements in the above described manner rather than in the column drive circuit as in known display devices operating with digital video signals results in considerable simplification of the column drive circuit compared with these known devices. The modification of the picture element circuit to provide a serial charge redistribution type digital to analogue converter to achieve this conversion requires only one additional TFT for each picture element and the subdivision of the display element to form two discrete capacitive sub-elements, both of which requirements can be accomplished in simple manner when fabricating the display panel.

As the column drive circuit is required to supply digital signals comprising two, or more, levels to the column conductors its circuitry can be purely digital. This greatly facilitates the integration of the circuit on the display panel using common processing techniques to fabricate both the array of picture elements and the column drive circuitry, although the simplification of the column drive circuit and its purely digital manner of operation still offer a number of advantages in the case where the circuit is fabricated separately from the display panel.

The nature of the signals supplied to the row conductors by the row drive circuit differs from that of conventional TFT display panels and their provision necessitates some modification to the conventional type of row drive circuit, which typically consists of a digital shift register circuit. However, the modifications are simple to provide, again using digital circuitry.

Both the drive circuits 21 and 25 can be constructed using TFTs and conveniently integrated on the same substrate as the array of picture element TFTs and the sets of address conductors 18 and 19, with the array of TFTs and the drive circuits being formed simultaneously by common processing, using for example polysilicon TFTs.

Applications for the display device include those where video information exists in a digital form, for example in the CD-I environment, or in datagraphic displays, and in display systems (supplied with either analogue or digital information). In a display device with drive circuits integrated on to the display it may be easier to implement a fully digital circuit as described than a conventional analogue circuit.

Although the display device described above comprises a liquid crystal display device, it is envisaged that other electro-optical material can be employed, for example electroluminescent or electrochromic materials.

From reading the present disclosure, other modifications will be apparent to persons skilled in the art. Such modifications may involve other features which are already known in the field of video matrix display apparatus and which may be used instead of or in addition to features already described herein.

I claim:

1. An active matrix display device comprising sets of row and column conductors, an array of picture elements each comprising a capacitive display element and a switching device connected to a row conductor and a column conductor, and drive means for driving the picture elements comprising a row drive circuit for applying switching signals to the row conductors, a column drive circuit connected to the column conductors for applying data signals to the column conductors, and means for supplying a digital picture information signal to the column drive circuit from which said data signals are derived, characterised in that the column drive circuit includes means for serially supplying multi-bit digital data signals to the column conductors the display element and the switching device of each picture element form parts of a respective serial charge redistribution digital-to-analog converter circuit for converting the multi-bit digital data signal on a respective one of the column conductors to an analog voltage for the display element, and the row drive circuit includes means for supplying timing signals to said converter circuit.

2. An active matrix display device according to claim 1, characterised in that the display element of each picture element comprises at least two display sub-elements each of which constitutes a respective capacitor component of the converter circuit.

3. An active matrix display device according to claim 1 or claim 2, characterised in that each converter circuit comprises two capacitors and two switching devices and in that the row drive circuit is operable to apply switching signals to the two switching devices via respective row conductors for operating the switching devices in a predetermined sequence according to the number of bits of the multi-bit data signal.

4. An active matrix display device according to claim 3, characterised in that a first switching device of each converter circuit of the picture elements in one row is connected to a respective row conductor and the second switching devices of the converter circuits of said picture elements are connected to another row conductor to which the first switching devices of an adjacent row of picture elements are also connected.

5. An active matrix display device according to claim 3, characterised in that the row drive circuit provides switching signals for operating in sequence the switching devices of picture elements in two rows during a common address period and the column drive circuit provides for each column conductor multi-bit digital data signals for respective picture elements in the two rows in said common address period with the bits of one multi-bit digital data signal being interleaved with the bits of the other digital data signal.

6. An active matrix display device according to claim 1 or 2, characterised in that the individual bits of a multi-bit data signal each comprise one of two predetermined voltage levels.

7. An active matrix display device according to claims 1 or 2, characterised in that the individual bits of a multi-bit data signal each comprise one of n predetermined levels where n is greater than two.

* * * * *